United States Patent [19]

Naito

[11] 4,072,179

[45] Feb. 7, 1978

[54] STRUCTURE ADAPTED TO BE SUCCESSIVELY DRAWN AND TELESCOPED

[76] Inventor: Han-Ichiro Naito, 15-1002, Wakaba-1-chome, Shinjuku, Tokyo, Japan

[21] Appl. No.: 754,057

[22] Filed: Dec. 23, 1976

[51] Int. Cl.[2] ..... E05D 15/06

[52] U.S. Cl. ..... 160/197; 160/202; 160/222

[58] Field of Search ..... 160/193, 197, 202, 222, 160/223; 49/227

[56] References Cited

U.S. PATENT DOCUMENTS

| | | | |
|---|---|---|---|
| 1,330,224 | 2/1920 | Whitsen | 160/202 |
| 2,057,850 | 10/1936 | Sims | 160/193 |
| 3,430,676 | 4/1969 | Aberg | 160/202 |
| 3,570,578 | 3/1971 | Lees | 160/202 |

*Primary Examiner*—Peter M. Caun

*Attorney, Agent, or Firm*—Pollock, Vande Sande & Priddy

[57] ABSTRACT

A structure comprising a plurality of partition members in sheet form each providing a pair of spaced opposite partition faces connected at one side and non-connected at the other side. These partition members are grouped into a telescoped assembly by guiding each of them into the internal space of another when not in use. When in use, the partition members are successively drawn from the telescoped assembly to provide continuous partition faces of a partition between two compartments of a room, sliding door or a window shutter.

14 Claims, 20 Drawing Figures

STRUCTURE ADAPTED TO BE SUCCESSIVELY DRAWN AND TELESCOPED

BACKGROUND OF THE INVENTION

This invention relates to a structure which can be telescoped into a small bulk when not in use and can be drawn or extended when in use to provide a partition between two compartments of a room, a sliding door or a window shutter.

Various types of partitions have been proposed hitherto. Known partitions include the panel type partition in which a plurality of partitioning panels divided into suitable lengths are movably fitted between guides fixed to the ceiling and floor to partition a room into two compartments. The folding screen type partition is also known in which an accordion-like folded partition member is used to partition a room into two compartments. While the panel type partition has a satisfactory sound insulation effect, it is defective in that it occupies a considerably large space when not in use and is not so easily handled. On the other hand, the folding screen type partition is advantageous in that it does not occupy a large space when not in use and it can be very easily handled. However, the folding screen type partition is defective in that its sound insulation effect is little as it is formed of a web of vinyl chloride resin, fabric or the like.

SUMMARY OF THE INVENTION

It is therefore a primary object of the present invention to provide a novel structure which does not occupy a large space when not in use, which can be easily handled, which can exhibit an improved sound insulation effect when used as a partition between two compartments of a room, and which be easily manufactured by virtue of simple construction.

In accordance with one aspect of the present invention, there is provided a structure comprising a plurality of partition members in sheet form each providing a pair of spaced opposite partition faces connected at one side and non-connected at the other side, and guide means for guiding movement of the partition members in a direction substantially parallel with the partition faces while supporting the partition members at least at one end located in parallel with the moving direction thereof, the partition members being successively grouped into a telescoped assembly when not in use by guiding each of them into the open internal space of another at the connected side and successively drawn out from the telescoped assembly when in use to provide continuous partition faces.

It is to be noted that the structure according to the present invention can also be used as a sliding entrance door of a house or a room or as a window shutter when the individual partition members are movably supported at both ends thereof by the guide means.

Other objects, features and advantages of the present invention will become apparent from the following detailed description of preferred embodiments thereof taken in conjunction with the accompanying drawing in which like reference numerals are used to denote like parts.

DETAILED DESCRIPTION OF THE PREFERRED EMBODIMENT

Figure 1:
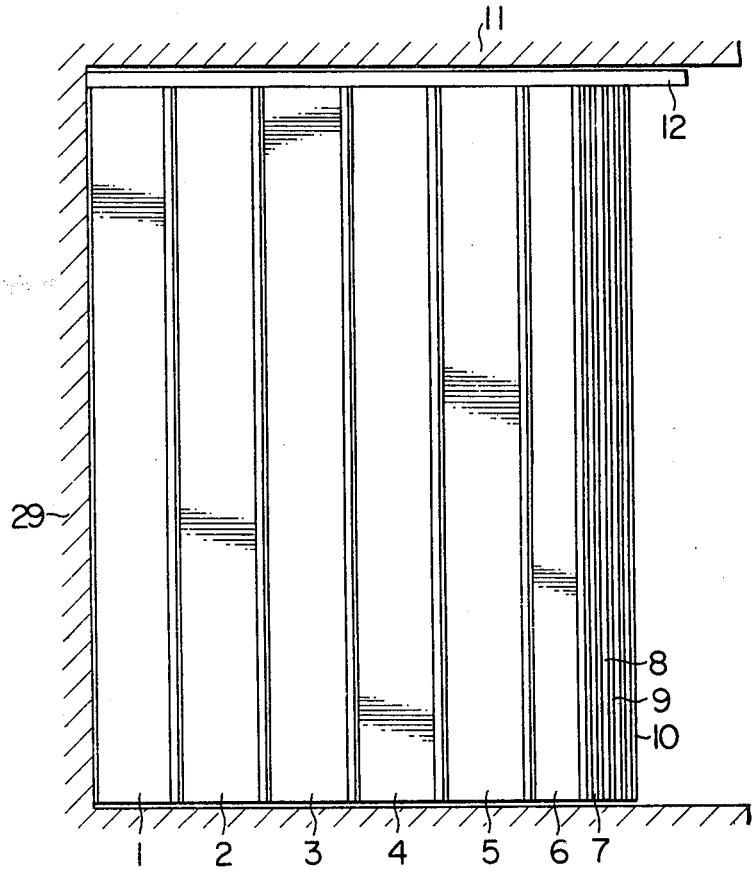
FIG. 1 is a schematic front elevational view showing some of partition members in a preferred embodiment in a drawn state when the structure according to the present invention is applied to a partition between two compartments of a room.

Referring now to the drawing, FIG. 1 shows a first preferred embodiment of the structure according to the present invention when applied to a partition used for partitioning a room into two compartments. The partition is composed of, for example, ten partition members 1 to 10 which are movably supported at the upper end thereof by a guide member 12 fixed to the ceiling 11.

Figure 2:
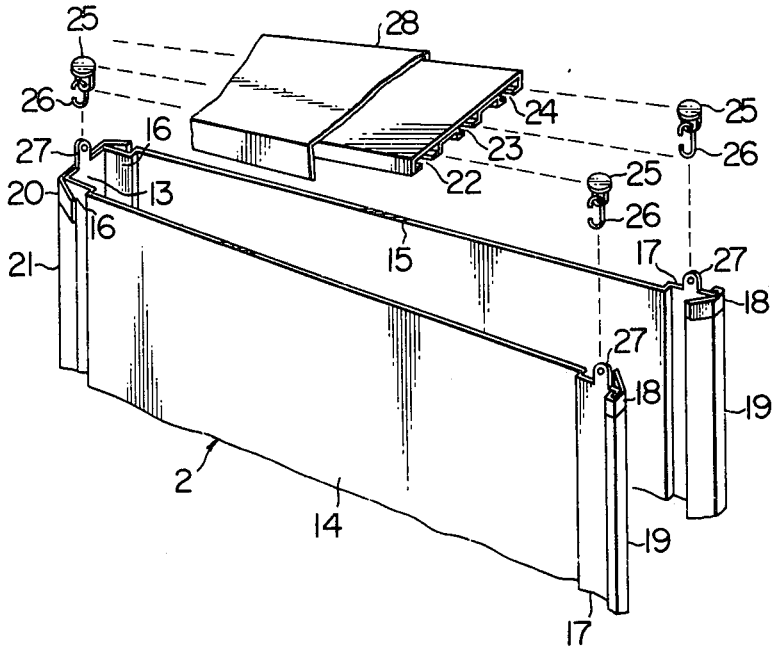
FIG. 2 is a schematic perspective view showing a manner of guiding one of the partition members by guide means.
Figure 3:
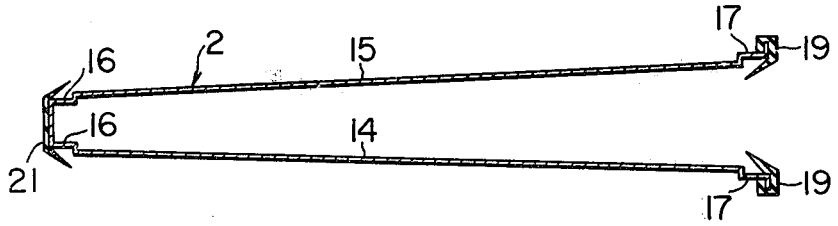
FIG. 3 is a schematic cross-sectional view of the partition member shown in FIG. 2.

The construction of these partition members 1 to 10 will be described in detail with reference to FIG. 2 in which only the partition member 2 is shown. Referring to FIG. 2, the partition member 2 is formed by bending into shape a sheet of metal such as aluminum or steel having an outer face coated in color to bear a pattern resembling the grain pattern of wood. The metal sheet is bent as by a press to provide a one-piece structure of substantially U-like cross-sectional shape consisting of a side portion 13 and a pair of partition portions 14 and 15. The side portion 13 of shortest length provides a side face, and the two partition portions 14 and 15 extend from the side portion 13 with a gradually increasing relative distance therebetween to provide a pair of partition faces. An inwardly protruding stepped section 16 is formed at the boundary between the partition portion 14 and the side portion 13, and an outwardly protruding stepped section 17 is formed adjacent to the open side of the partition portion 14. The terminal edge of this stepped section 17 is bent outwardly to extend in substantially parallel relation with the side portion 13. An interconnecting element 18 is mounted on the top of the outwardly bent terminal edge of the stepped section 17 of the partition portion 14 to clamp this terminal edge at one end thereof while protruding diagonally inward at the other end thereof. A lining 19 of resilient material having a low coefficient of friction, such as rubber or elastic synthetic resin, is fixed to the terminal edge of the stepped section 17 of the partition portion 14 and extends from the lower end of the interconnecting element 18 to the lower end of the partition portion 14. This lining 19 has a cross-sectional shape as best shown in FIG. 3 so as to cover the terminal edge of the stepped section 17 of the partition portion 14 at one end thereof while protruding diagonally inward at the other end thereof. The partition portion 15 is similarly provided with such stepped sections 16 and 17, interconnecting element 18 and lining 19.

Another interconnecting element 20 is fixed at its middle part to an upper end of the side portion 13 of the partition member 2 and has both ends thereof bent diagonally outward to be directed toward the associated stepped sections 16. Another lining 21 of resilient material having a low coefficient of friction, such as rubber or elastic synthetic resin, is fixed at its middle part to the stepped section 16 to extend from the lower end of the interconnecting element 20 to the lower end of the side portion 13 and has both ends thereof bent diagonally outward to be directed also toward the associated stepped sections 16, as shown in FIGS. 2 and 3.

Holes 27 are bored in the upper end of the side portion 13 and those of the stepped sections 17 of the partition portions 14 and 15 to be respectively engaged by hooks 26 of sliding pieces 25 movably received in guide rails 22, 23 and 24 such as curtain-rods. Therefore, a three-point suspension arrangement is provided in which the side portion 13, partition portions 14 and 15 of the partition member 2 are respectively suspended or supported by the sliding pieces 25 received in the guide rails 23, 22 and 24. A cover 28 covers the guide rails 22, 23 and 24.

The partition member 1 is anchored to a pillar or wall 29 of a room at its side portion 13. Therefore, the interconnecting element 20 and lining 21 provided on the side portion 13 of the partition member 2 are unnecessary in the case of the partition member 1. Except for the above difference, the partition member 1 is entirely the same as the partition member 2 in shape and construction. The partition member 10 is detachably fixed to another wall of the room at the open side thereof. Therefore, the interconnecting elements 18 and linings 19 provided on the partition member 2 are unnecessary in the case of the partition member 10. Except for the above difference, the partition member 10 is entirely the same as the partition member 2 in shape and construction. In the case of the partition member 10, therefore, a plate (not shown) of the same material as that of the partition plates or of synthetic resin may be mounted on the open side to close the same. Means for joining the partition members 1 and 10 to the pillars or walls of the room may be the same as those conventionally used for folding screens and will not be specifically described nor illustrated.

The remaining partition members 3 to 9 are entirely the same as the partition member 2 in shape and construction and are similarly movably supported by the three guide rails 22, 23 and 24.

Figure 4:
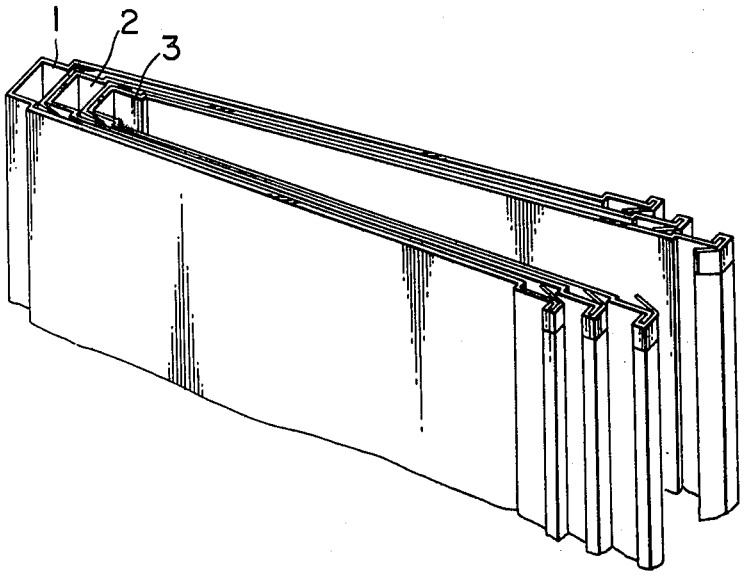
FIG. 4 is a schematic perspective view showing three of the partition members grouped into a telescoped assembly.
Figure 5:
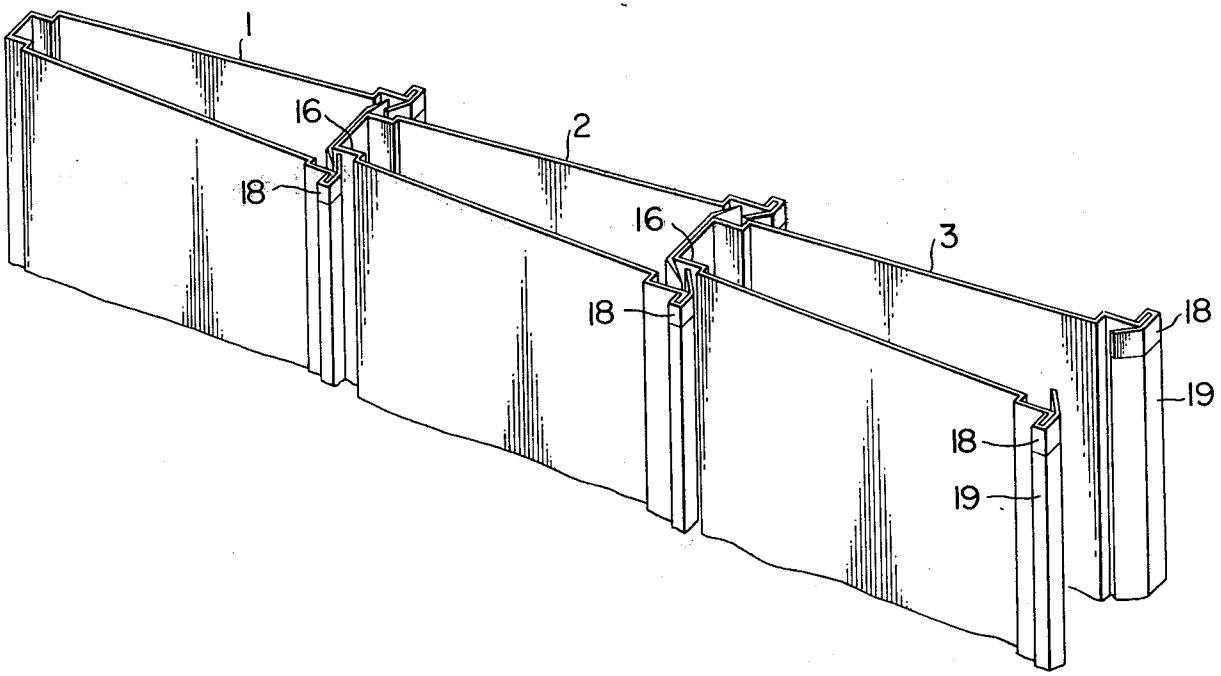
FIG. 5 is a schematic perspective view showing the three partition members fully drawn from the state shown in FIG. 4.

FIG. 4 shows a telescopically grouped state of three of these partition members when not in use. These three partition members 1, 2 and 3 are drawn from the telescoped state shown in FIG. 4 to a fully drawn state as shown in FIG. 5. At first, the user grasps the openside terminal edge of the partition member 3 with his hand to draw the same rightward in FIG. 4. The interconnecting element 20 on the side portion 13 of the partition member 3 engages with the interconnecting elements 18 on the open-side terminal edge of the partition member 2, and with further rightward drawing movement of the partition member 3, the partition member 2 is drawn out of the internal space of the partition member 1 which is anchored at its side portion 13 to the wall 29 of the room. Thus, the drawing movement is completed when the interconnecting element 20 of the partition member 2 engages with the interconnecting elements 18 of the partition member 1. In the fully drawn state, the lining 21 on the partition member 3 engages with the linings 19 on the partition member 2, and the lining 21 on the partition member 2 engages with the linings 19 on the partition member 1 to close the gap between these partition members. Thus, a completely double-walled structure is provided which improves the sound insulation effect.

When not in use, the partition members 2 and 3 are telescoped into the internal space of the partition member 1 again. In this case, the user grasps the openside terminal edge of the partition member 3 with his hand to move the same leftward in FIG. 5. At first, the partition member 3 is received in the internal space of the partition member 2, and then, the partition members 3 and 2 are received in the internal space of the partition member 1. During this operation, the interconnecting elements 18 and linings 19 on the partition members 1 and 2 are pressed inward by the partition portions 14 and 15 of the partition members 2 and 3. However, due to the fact that the outwardly protruding stepped sections 17 are provided at the open-side terminal edge of the individual partition members, these interconnecting elements 18 and linings 19 are pressed to be snugly received in the spaces defined by the stepped sections 17. The interconnecting elements 20 and linings 21 on the side portions 13 of the partition members 2 and 3 are also pressed to be snugly received in the spaces defined by the inwardly protruding stepped sections 16 of the respective partition members. The lining 21 on the outer partition member engages with the stepped sections 16 of the inner partition member to prevent excessive insertion of the inner partition member into the internal space of the outer partition member.

As above described, it is necessary to cause inward bending of the interconnecting elements 18 and 20 when they are engaged by the partition portions during the telescopic grouping of the partition members 1 to 3. Restraining means (not shown) is preferably provided to restrain outward bending of the interconnecting elements 18. That is, the interconnected elements 18 must be restrained from bending outward in order that those of the inner partition member can engage with the interconnecting element 20 of the outer partition member to permit drawing of the successive partition members from the telescopically grouped state. The interconnecting elements 18 and 20 need not possess a high mechanical strength when the sliding pieces 25 are arranged to slide along the guide rails 22, 23 and 24 with a low coefficient of friction. The moving direction of the partition members is limited by the guide rails 22, 23 and 24. Therefore the, outer face of the inner partition member being telescoped into the outer partition member would not make rubbing engagement with the inner face of the outer partition member. A material such as polytetrafluoroethylene resins having a low coefficient of friction is preferably coated on the entire area or selected portions of the inner face of the partition portions of the partition members to reduce the frictional contact.

Figure 6:
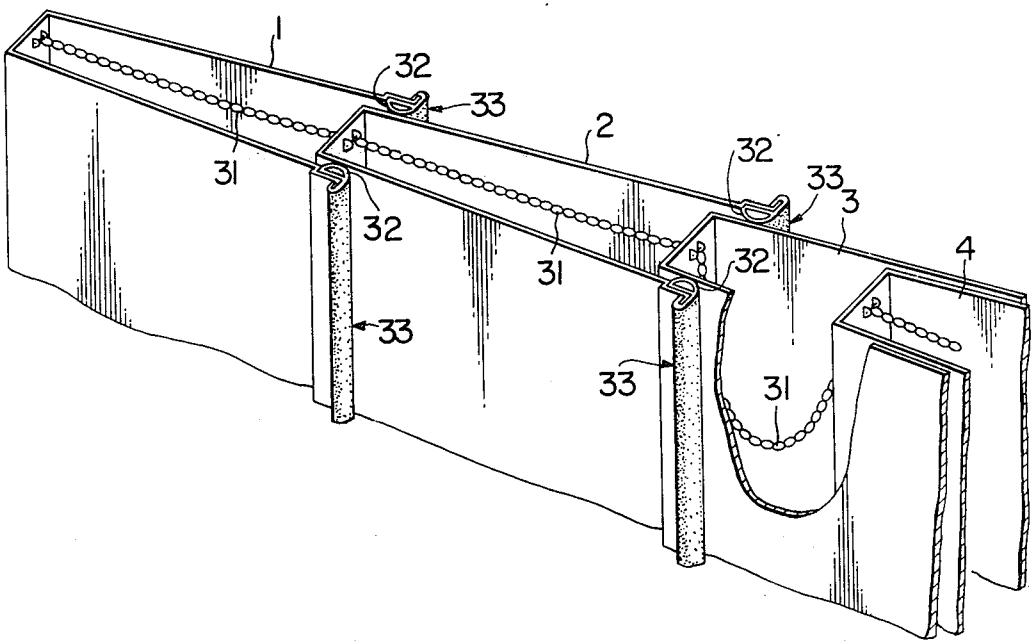
FIG. 6 is a schematic perspective view with part cut-away to show some of the partition members in a second preferred embodiment of the present invention in a fully drawn state.
Figure 7:
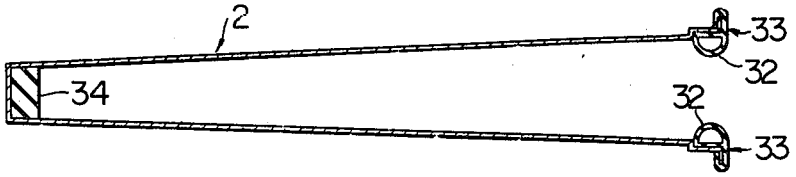
FIG. 7 is a schematic cross-sectional view of one of the partition members shown in FIG. 6.

FIGS. 6 and 7 show a second preferred embodiment of the present invention which is actually a modification of the first embodiment. Referring to FIG. 6, the interconnecting elements 18 and 20 are replaced by a flexible linear linking element 31 such as a strap or string of steel balls which extends between the side plates 13 of the adjoining partition members. This linear linking element 31 is sufficiently long so that at least a part of the closed side of the partition portions of the inner partition member can be situated within the open side of the outer partition member in the fully drawn state. Referring to FIG. 7, a lining 33 of resilient material having a low coefficient of friction extends from the top to the bottom of each of the terminal edges of the stepped portions 17 of the partition members. Each lining 33 covers the terminal edge of the associated stepped section 17 of the partition portion and is formed with an inwardly protruding hollow projection 32. These projections 32 have a sufficient height so that those on the outer partition member can engage with the partition portions on the closed side of the inner partition member in the fully drawn state. Further, these projections 32 are hollow so that those on the outer partition member can be easily deformed or flattened by being pressed by the partition portions of the inner partition member in the telescoped state. In this second embodiment, therefore, the stepped sections 16 and linings 21 provided in the first embodiment are unnecessary. A stopper 34 of resilient material such as rubber or elastic synthetic resin is shown in FIG. 7 and has a sufficient thickness so that the inner partition member being telescoped may not be forced into the outer partition member more than is required. This stopper 34 acts also as a cushion for the inner partition member being telescoped into the outer partition member. This stopper 34 is provided on all the partition members except that which is the innermost one in the telescoped assembly. The stopper 34 need not extend from the top to the bottom of the side portion of each of these partition members. A single stopper 34 may be mounted on the middle portion of the inner face of the side portion, or a plurality of such stoppers 34 may be mounted in suitably vertically spaced relation. In lieu of the above position, such stopper or stoppers may be mounted on the outer face of the side portion.

Figure 8:
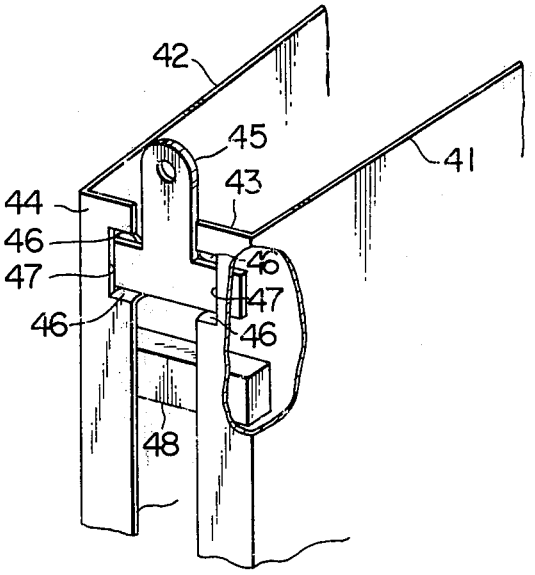
FIG. 8 is a schematic perspective view with part cut-away to show part of one of the partition members in a third preferred embodiment of the present invention.

FIG. 8 shows a third preferred embodiment of the present invention in which each partition member is composed of a pair of independent partition plates 41 and 42 which are connected together in the area of the side portion 13 of the partition members employed in the first and second embodiments.

Referring to FIG. 8, the partition plates 41 and 42 are bent at one end thereof substantially normal to their partition face to provide a pair of side portions 43 and 44 respectively, and a stepped section 17 (not shown) similar to that in the first embodiment is formed at the other end of each of the partition plates 41 and 42. The side portions 43 and 44 have such an angle relative to the partitioning direction that the relative distance between the partition faces of the partition plates 41 and 42 increases gradually from the position of their side portions 43 and 44. The partition plates 41 and 42 are formed in the area of their side portions 43 and 44 with holding portions 46 which hold a hanger 45 suspended from a guide rail 23 of the kind as shown in FIG. 2. These holding portions 46 are formed by suitably cutting a vertical slit in the confronting end edge sections of the side portions 43 and 44, cutting to remove the middle part of the slitted portions, and bending the remaining slitted portions. The hanger 45 is supported by being held between the inner face of the side portions 43, 44 and the holding portions 46. When so required, the hanger 45 may be welded or otherwise fixed to the holding portions 46 or the inner face of the side plates 43 and 44. A resilient element 48 may be provided to engage at both ends thereof with the inner face of the partition plates 41 and 42 and at one side thereof with the inner face of the side portions 43 and 44 so as to cushion inwardly directed pressure imparted to the partition plates 41 and 42.

In the third embodiment above described, a pair of independent plates are used to constitute a partition member unlike the first and second embodiments. Thus, the partition member can be more easily manufactured. Further, the independent plates can be assembled on the site of construction to facilitate handling of the partition member. This third embodiment is therefore suitable for an application where each partition member has a large surface area. In FIG. 8, only one supporting point is provided at the side face of the partition member as in the first embodiment. However, the hanger 45 may merely be used as a connecting means for the plates 41 and 42, and holes may be bored in the upper end of the partition portions and side portions to provide four supporting points to be supported by four support or guide rails.

It will be understood from the above description that each of the partition members in the first, second and third embodiments comprises a plate or plates providing one side face and a pair of opposite partition faces extending substantially normal to the side face with a relative distance therebetween gradually increasing toward the other side. The other side opposite to the closed side is open to receive the adjoining partition member therein so that the inner partition member can be telescoped into the outer partition member to provide a telescoped assembly of small bulk. The plates constituting the partition members are preferably as thin as possible so that a plurality of these partition members can be telescoped to provide a telescoped assembly having a small assembled angle and a small bulk which facilitates transportion and storage.

FIGS. 9 to 12 show a fourth embodiment of the present invention in which each partition member is composed of a pair of independent plates as in the third embodiment.

Figure 9:
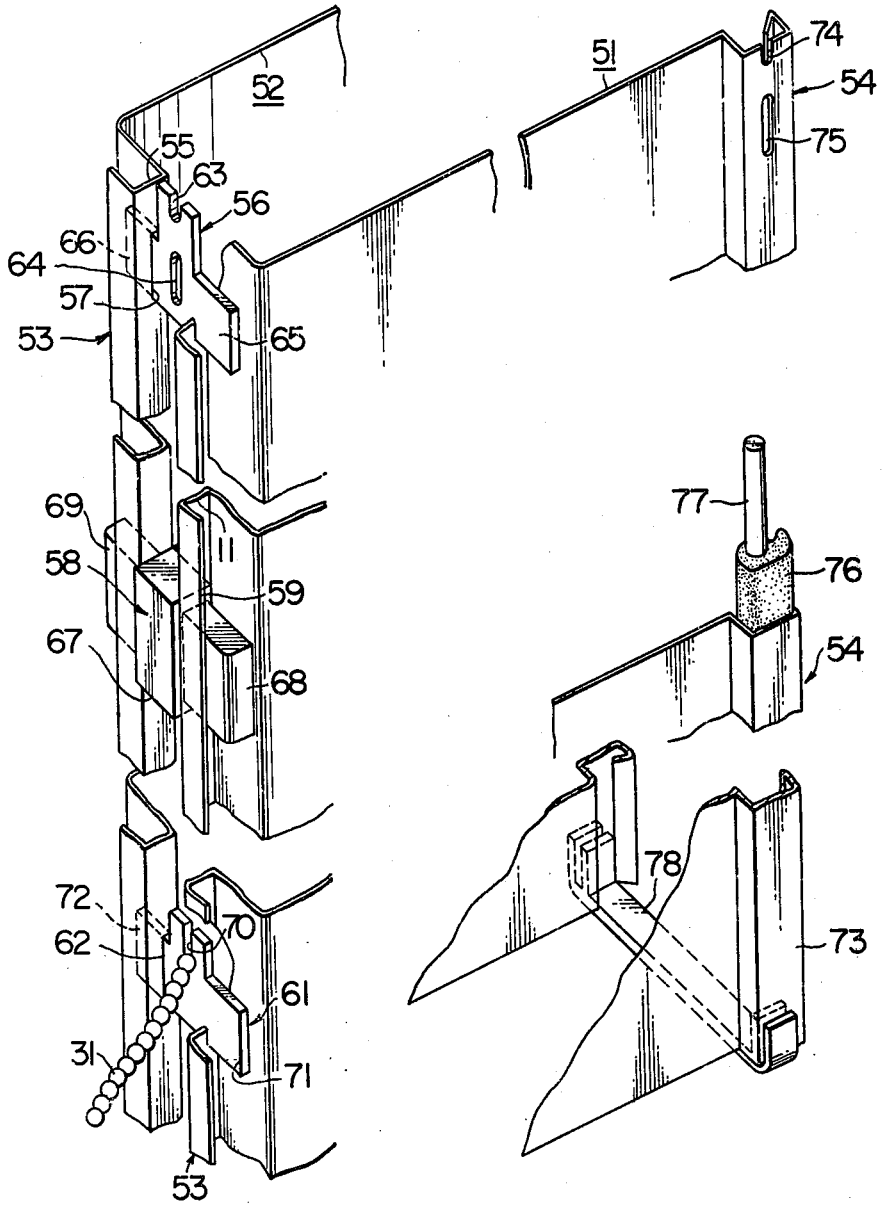
FIG. 9 is a schematic perspective view with part cut-away to show part of one of the partition members in a fourth preferred embodiment of the present invention.
Figure 10:
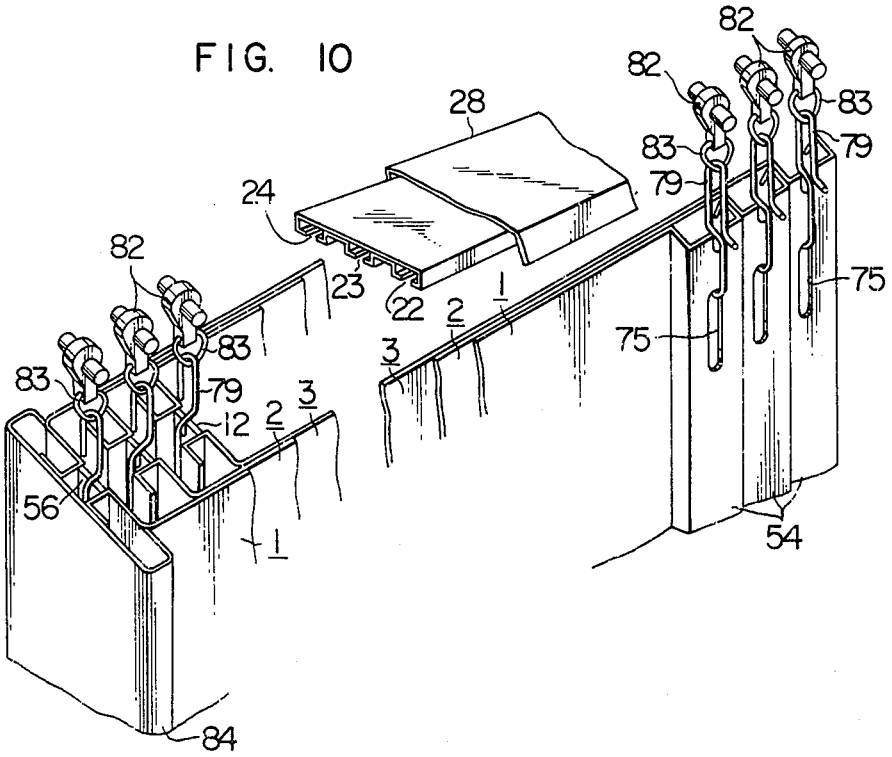
FIG. 10 is a schematic perspective view showing some of the partition members in the fourth embodiment in a telescoped state together with guide means guiding these partition members.

Referring to FIGS. 9 and 10, a partition member 2 is composed of a pair of partition plates 51 and 52 which are each formed at one end thereof with an inwardly protruding stepped section 53 and at the other end thereof with an outwardly protruding stepped section 54. The plate portion 55 of each stepped section 53 bent in parallel with the partition face is provided at an upper part thereof with a vertically extending slot 57 for receiving therein one end of a hanger 56 of substantially inverted-T shape, and at a middle part thereof with another vertically extending slot 59 for receiving therein one end of a resilient connecting element 58. This plate portion 55 is also provided at a lower part thereof with another vertically extending slot 62 for receiving therein one end of an interconnecting element 61 of substantially inverted-T shape to which one end of a flexible linear linking element 31 such as a strap or string of steel balls is fixed for interconnection between the adjoining partition members.

A cutout 63 is provided at an upper central part of the hanger 56 of substantially inverted-T shape, and a vertically extending slot 64 is provided beneath this cutout 63. The hanger 56 comprises a pair of horizontal wings 65 and 66 which are received loosely in the slots 57 of the partition plates 51 and 52 respectively.

The resilient connecting element 58 is formed of a resilient material such as rubber or elastic synthetic resin. The main body 67 of the connecting element 58 determines the space between the stepped sections 53 of the partition plates 51 and 52 connected together at this side, and a pair of wings 68 and 69 extend horizontally in directions opposite to each other from the main body 67 to be received loosely in the slots 59 of the partition plates 51 and 52 respectively. These wings 68 and 69 are shaped to have a suitable cross-section such as a substantially flat-oval cross-section so as to normally resiliently bias the other or open side of the partition plates 51 and 52 toward each other in a closing direction.

A cutout 70 is provided at an upper central part of the interconnecting element 61 of substantially inverted-T shape, and one end of the linking element 31 is fixedly received in this cutout 70. The interconnecting element 61 comprises a pair of horizontally extending wings 71 and 72 which are received loosely in the slots 62 of the partition plates 51 and 52 respectively.

The end edge of the stepped section 54 of each of the partition plates 51 and 52 is bent at a suitable angle within the stepped section 54 as shown in FIG. 9. A cutout 74 is provided at an upper central part of the plate portion 73 of the stepped section 54 bent in parallel with the partition face, and a vertically extending slot 75 is provided beneath this cutout 74. A lining 76 of resilient material having a low coefficient of friction, such as rubber or elastic synthetic resin, is fitted in the stepped section 54 and protrudes at its top end beyond the upper end of the associated partition plate. A rod 77 of metal extends vertically through this lining 76 to serve as a reinforcement which prevents vertical bending of the associated partition plate.

Another connecting element 78 of resilient material having forked ends is provided to hold the lower part of the plate portions 73 of the stepped sections 54 of the partition members 51 and 52 between the fork. This resilient connecting element 78 is arranged to have its upper face located beneath the lower end of the partition plates 51 and 52 so as not to obstruct insertion of the adjoining partition members relative to each other.

As shown in FIG. 10, a hook 79 of substantially 8-like shape engages at its lower ring with the cutout 63 and slot 64 of each of the hangers 56. Such a hook 79 is also shown engaging with the cutout 74 and slot 75 of each of the stepped sections 54. The upper link of each hook 79 is engaged by a suspending link 83 of a sliding piece 82. The hook 79 engaging with the stepped section 54 of the partition plate 51 is supported by the sliding piece 82 received in a guide rail 22, and the hook 79 engaging with the hanger 56 is supported by the sliding piece 82 received in another guide rail 23, while the hook 79 engaging with the stepped section 54 of the partition plate 52 is supported by the sliding piece 82 received in another guide rail 24. Thus, each partition member is movably supported at three points as in the first embodiment.

Figure 11:
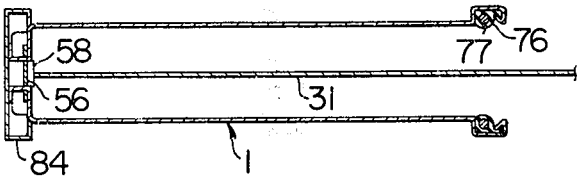
FIG. 11 is a schematic cross-sectional view of the outermost one of the partition members shown in FIG. 10.

Referring to FIGS. 10 and 11, a cover member 84 covers the stepped sections 55 of a partition member 1 and serves as a grip to be engaged by the hand during drawing. The partition member 1 is entirely the same in shape and construction as the partition member 2 except for the above difference.

Figure 12:
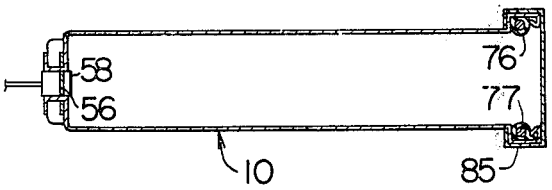
FIG. 12 is a schematic cross-sectional view of the innermost one of the partition members shown in FIG. 10.

Referring to FIG. 12, a cover member 85 covers the open side of a partition member 10 and serves to join the partition member 10 to a pillar or wall 29 of a room. Means for joining the partition member 10 to the pillar or wall 29 may be the same as that conventionally used for a folding screen and will not be specifically described nor illustrated. This partition member 10 is also entirely the same in shape and construction as the partition member 2 except the above difference. The remaining partition members 3 to 9 are also entirely the same in shape and construction as the partition member 2.

In the fourth embodiment, the partition plates 51 and 52 of each of the partition members 1 to 10 are biased at their stepped sections 54 toward each other by the wings 68 and 69 of the resilient connecting element 58. Thus, the stepped sections 54 of, for example, the partition member 1 are brought into intimate contact with the partition plates 51 and 52 of the partition member 2 in the fully drawn state, and the linings 76 cooperate with then to provide a completely double-walled structure which improves the sound insulation effect. The width of the main body 67 of the resilient connecting element 58 in a direction normal to the partition faces determines the space between the stepped sections 53 of the partition plates 51 and 52. Therefore, when this width is suitably selected to establish a substantially parallel relationship between the partition plates 51 and 52 of each partition member in the fully drawn state, the partition faces of the partition thus completed are substantially flat except the stepped sections 54 and will not impair the beautiful appearance of the partition.

When telescoped together, the partition members 2 to 10 are received in the interval space of the partition member 1. The outward expansion of the partition member 1 in this telescoped state is resiliently absorbed by the wings 68 and 69 of the resilient connecting element 58. In the fourth embodiment, the resilient connecting element 78 additionally provided for connecting the lower ends of the partition plates 51 and 52 cooperates with the cover member 84 so as to also restrain such outward expansion of the partition plates 51 and 52 in the fully drawn state in addition to the telescoped state.

In the present embodiment, the string of steel balls as the linking element 31 is used to connect one partition member to the adjoining one and extends between the interconnecting elements 61 with a length corresponding to the maximum drawn distance each partition member. This string of steel balls can be easily fixed to the associated interconnecting element 61 by fitting the same in the cutout 70 at the portion intermediate the balls.

FIGS. 13 to 16 show a fifth embodiment of the present invention which is actually a modification of the fourth embodiment. In this embodiment, a resilient restraining element 101 is additionally provided in the fourth embodiment so as to restrain outward expansion of the partition plates 51 and 52 in the area of the stepped sections 54 in the fully drawn state.

Figure 13:
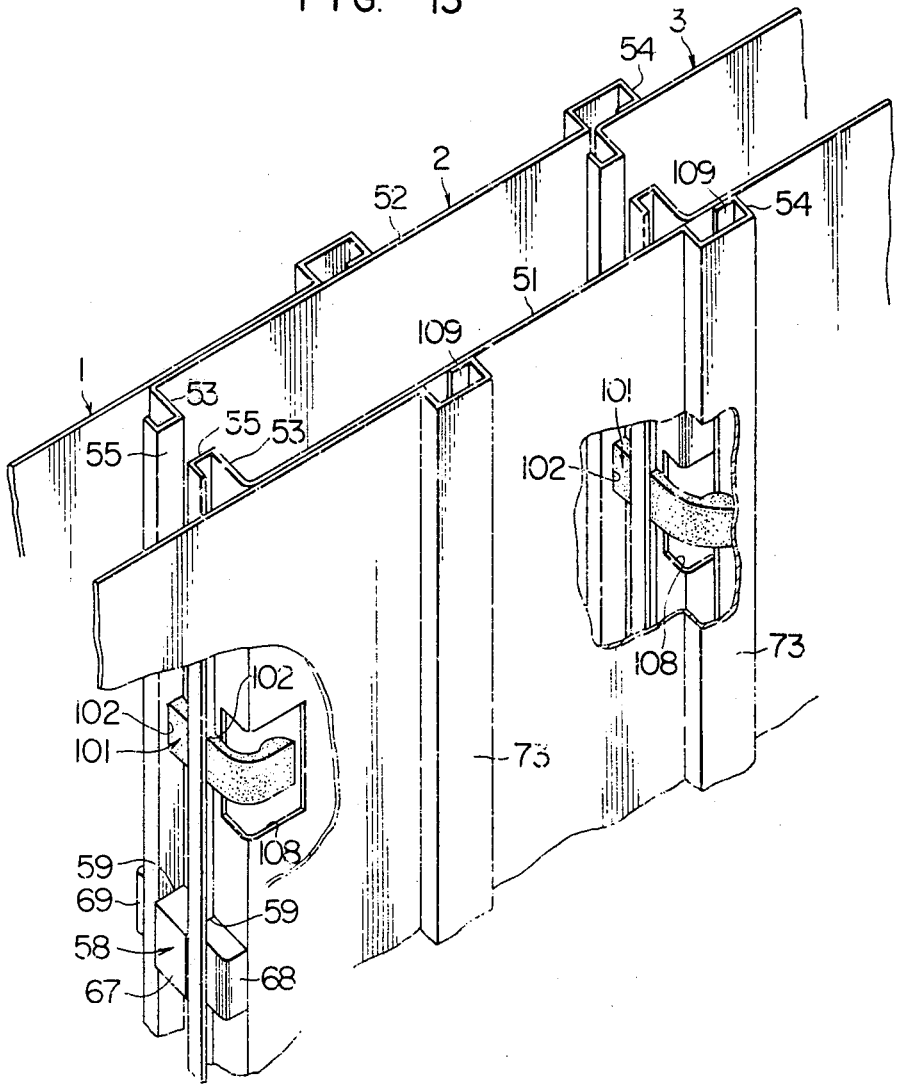
FIG. 13 is a schematic perspective view with part cut-away to show part of the partition members in a fifth preferred embodiment of the present invention.
Figure 14:
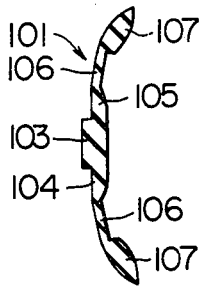
FIG. 14 is a schematic plan view of a resilient restraining element employed in the fifth embodiment.

Referring to FIG. 13, a pair of vertically extending slots 102 are provided in the respective plate portions 55 of the stepped sections 53 of the partition plates 51 and 52 for receiving therein the resilient restraining element 101. Referring to FIG. 14, the resilient restraining element 101 comprises a main body 103 which determines the space between the stepped sections 53 of the partition plates 51 and 52 connected together at this side. A pair of wings 104 and 105 extend horizontally in directions opposite to each other from this main body 103 to be received loosely in the slots 102 of the partition plates 51 and 52 respectively. Each of these wings 104 and 105 comprises a thin portion 106 formed adjacent to the main body 103 and an engaging portion 107 of substantially flat-oval shape formed adjacent to the thin portion 106 for engagement with the associated stepped section 54. The length between the ends of the engaging portions 107 is selected to be greater than the distance between the partition plates 51 and 52. This resilient restraining element 101 is a one-piece structure of a resilient material such as rubber, polypropyrene, Vinylon or like elastic synthetic resin.

Figure 15:
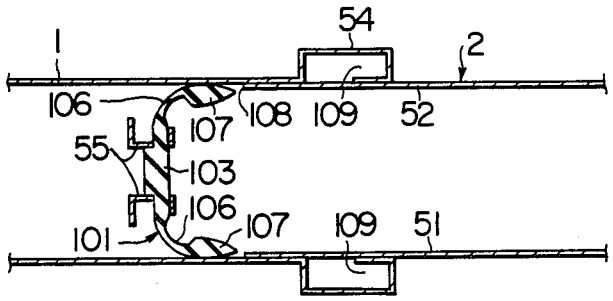
FIG. 15 is a schematic plan view showing the relation between the resilient restraining element and the partition members in a partly drawn state.

As shown in FIGS. 13 and 15, the resilient restraining element 101 extends between the partition plates 51 and 52 while being bent in a pair of openings 108 provided in the portion plates 51 and 52 in the vicinity of the slots 102 of the plate portions 55 of their stepped sections 53. Therefore, the engaging portions 107 of the resilient restraining element 101 mounted in, for example, the partition member 2 engage at their outer face resiliently with the inner face of the partition plates 51 and 52 of the partition member 1. The resilient biasing force imparted by the engaging portions 107 of the resilient restraining element 101 is selected to be less than the inward biasing force of the resilient connecting element 58. The engaging portions 107 engaging with the partition plates 51 and 52 are preferably treated at their outer face with a suitable material providing a low coefficient of friction.

In this embodiment, the end edge of each of the stepped sections 54 is bent in parallel with the partition face as shown by 109 in FIG. 13, and the associated engaging portion 107 of the resilient restraining element 101 engages with this bent portion 109.

When, for example, the partition member 2 is telescoped into the internal space of the partition member 1, the resilient restraining element 101 in the inner partition member 2 is bent at its thinner portions 106 by the partition plates 51 and 52 of the outer partition member 1. The resilient restraining element 101 in the inner partition member 2 engages at its engaging portions 107 with the inner face of the partition plates 51 and 52 of the outer partition member 1 through the openings 108 as seen in FIGS. 13 and 15. In this case the partition plates 51 and 52 of the outer partition member 1 would not be urged away from each other, since the outward biasing force imparted by the engaging portions 107 of the resilient restraining element 101 to the inner face of the partition plates 51 and 52 of the outer partition member 1 is less than the inward biasing force imparted by the wings 68 and 69 of the resilient connecting element 58.

Figure 16:
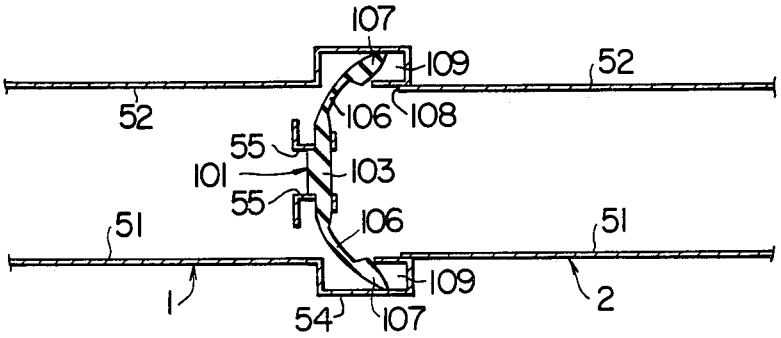
FIG. 16 is a view similar to FIG. 15, but showing the relation between the resilient restraining element and the partition members in a fully drawn state.

When the partition member 1 is moved leftward from the position shown in FIGS. 13 and 15, diagonally outward pressure having been imparted by the thinner portions 106 of the resilient restraining member 101 and the vertical pressure having been imparted by the engaging portions 107 of the resilient restraining member 101 in FIG. 15 are replaced by the pressure which is directed diagonally rearward relative to the moving direction. The wings 104 and 105 of the resilient restraining member 101 in the partition member 2 are permitted to extend into the stepped sections 54 of the partition member 1 when the bent portion 109 of the stepped sections 54 of the partition member 1 register with the openings 108 of the partition member 2. With further leftward movement of the partition member 1 in FIG. 15, the engaging portions 107 of the resilient restraining element 101 engage finally with the inner face of the stepped sections 54 of the partition member 1 as shown in FIG. 16. The fully extended length of the wings 104 and 105 of the resilient restraining element 101 is selected so as not to urge the stepped sections 54 away from each other. Therefore, no outward pressure is imparted to the stepped sections 54 of the partition member 1 in the fully drawn state, although the stepped sections 54 are engaged by the resilient restraining element 101 of the partition member 2.

When each individual partition member is fully drawn to constitute the partition, the wings 68 and 69 of the resilient connecting element 58 act to bias the stepped sections 54 toward each other. Thus, the stepped sections 54 of, for example, the partition member 1 are brought into intimate contact with the partition plates 51 and 52 of the partition member 2, and the partition members provide a completely double-walled structure which improves the sound insulation effect. The dimensions of the main bodies 103 and 67 of the restraining element 101 and connecting element 58 respectively determine the space between the stepped sections 53 of the partition member. Therefore, these dimensions are preferably selected to establish a substantially parallel relationship between the partition faces provided by the partition plates 51 and 52 of the individual partition members in the fully drawn state, so that the overall partition faces can be rendered substantially flat, except the protruding stepped sections 54, without impair the beautiful appearance of the partition.

Figure 17:
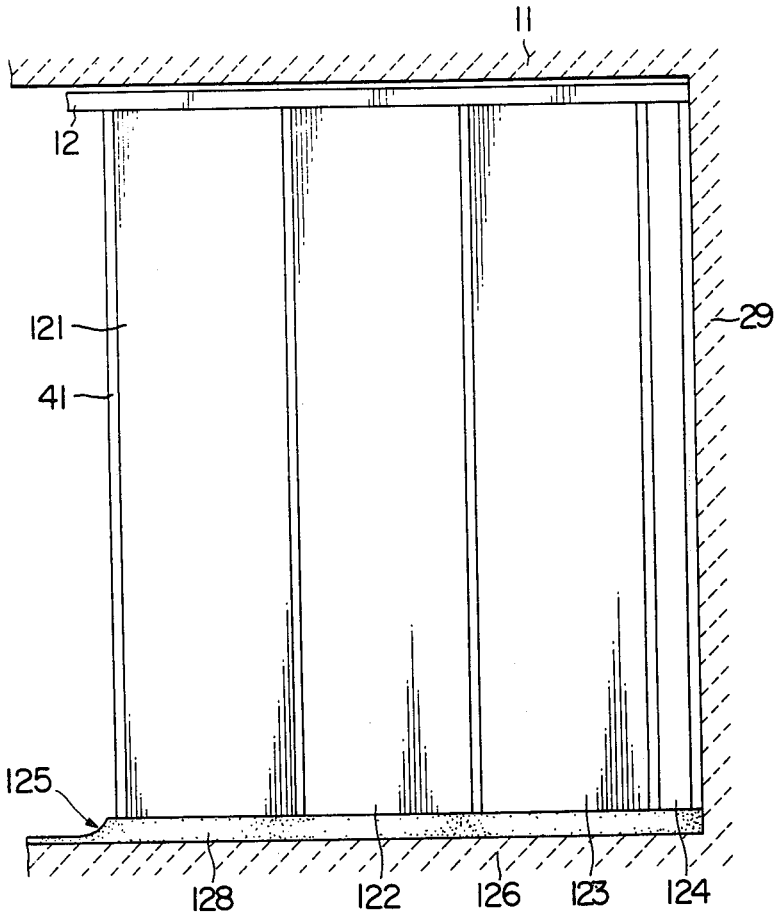
FIG. 17 is a schematic front elevational view showing holding means used for holding the lower end of partition members in a sixth preferred embodiment of the present invention, in which the partition members are shown in a partly drawn state.

FIGS. 17 to 20 show one form of holding means used for holding the lower end of partition members in a sixth preferred embodiment of the present invention. In this embodiment, four partition members 121, 122, 123 and 124 as shown in FIG. 17 constitute a partition partitioning a room into two compartments, and the outermost partition member 121 is initially drawn to complete the partition.

Figure 20:
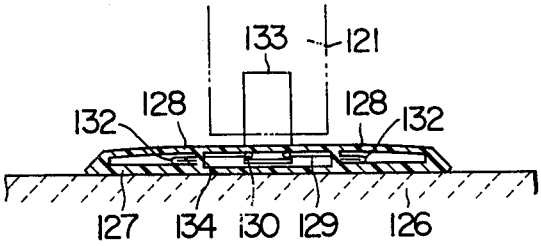
FIG. 20 is a schematic vertical sectional view showing the strips of the holding means in a joined and flattened state.

A holder 125 extends on a floor 126 in parallel with an upper guide member 12. This holder 125 comprises a base 127 fixed to the floor 126 and having a width larger than the thickness of the partition members 121 to 124, a pair of upper covers 128 fixed at one end thereof to the base 127 and adapted to be releasably brought into abutment with each other at the other end thereof on the longitudinal centerline of the base 127, and a pair of tapes 129 extending substantially bodily along the lower face of the respective upper covers 128. Teeth 130 of a slide fastener are mounted on the other end of each of the tapes 129 to be releasably brought into meshing engagement by a sliding element 131 of the slide fastener. When the teeth 130 are brought into meshing engagement by the sliding element 131, the upper covers 128 are brought into abutment with each other to be substantially flattened on the base 127. A pair of pliable restraining strips 132 are interposed between the base 127 and the upper covers 128 so as to restrain the amount of parting movement of the upper covers 128 which are forced away from each other with the movement of the partition members 121 to 124. The restraining strips 132 are folded in a manner as shown in FIg. 20 when the teeth 130 of the slide fastener are brought into meshing engagement. The sliding element 131 is mounted on one end of a carrier 133 which is fixed at the other end thereof to a cover member 84 for the leading partition member 121. A longitudinal central groove 134 is provided on the base 127 to receive the upper covers 128 therein when the upper covers 128 are flattened with the movement of the sliding element 131 carried by the carrier 133.

Figure 18:
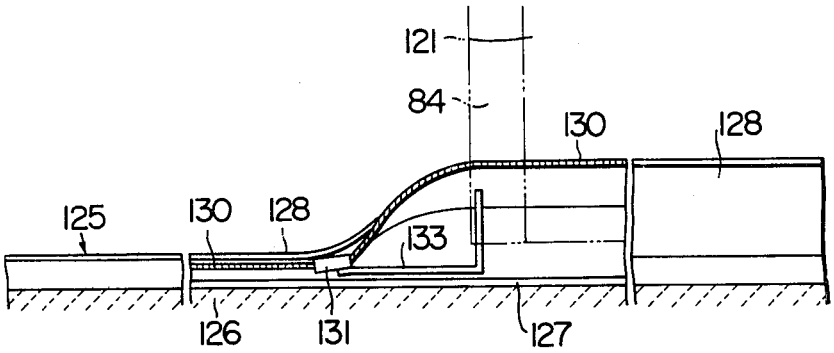
FIG. 18 is a schematic front elevational view with part cut-away to show how strips of the holding means are parted by the leading partition member.
Figure 19:
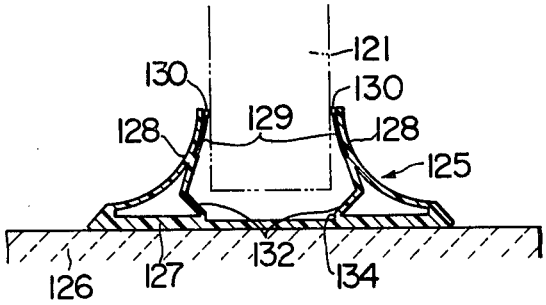
FIG. 19 is a schematic vertical sectional view showing the strips of the holding means in the parted state.

As the leading partition member 121 is drawn to constitute the partition between the two compartments of the room, the sliding element 131 releases the meshing engagement between the teeth 130 as shown in FIG. 18. The tapes 129 and upper covers 128 are forced upward by the cover member 84 to hold therebetween the lower partition face portions of the partition member 121 thereby preventing rolling of the lower part of the partition member 121. The partition members 122, 123 and 124 successively drawn with further drawing movement of the partition member 121 can also be held at their lower part by the holder 125 against rolling. Thus, all the partition members 121 to 124 are prevented from rolling in the course of drawing movement to complete the partition.

The partition members 121 to 124 constituting the partition are moved rightward in FIG. 17 to be grouped into the telescoped assembly. With rightward movement of the partition member 121, the sliding element 131 brings the teeth 130 into meshing engagement again, and the upper covers 128 are substantially flattened as shown in FIG. 20. Therefore, when the partition members 121 to 124 are grouped into the telescoped assembly, the holder 125 is substantially bodily flattened to leave a slight thickness on the floor 126 as seen in FIG. 20. The transverse end edges of the holder 125 may be suitably tapered as illustrated to prevent stumbling or other trouble. The holder 125 may be detachably mounted on the floor 126, and the sliding-element carrier 133 may be detachably mounted on the cover member 84 of the leading partition member 121 so as to permit removal of the entire holder 125 when the partition members 121 to 124 are grouped into the telescoped assembly.

Although the holder in the sixth embodiment is illustrated to include a slide fastener to releasably hold the lower part of the partition members, those skilled in the are will readily understand that the slide fastener may be replaced by a nylon tape fastener or a so-called vinyl fastener comprising a male element adapted to be fitted in a continuous groove.

The embodiments above described have referred to an application of the structure according to the present invention to a partition used for partitioning a room into two compartments. It is apparent that the structure according to the present invention is applicable to a sliding entrance door of a house or room and also to a sliding shutter mounted outside of a door or window to protect against wind or rain, due to the fact that the partition members of double-walled structure exhibit the open-air shutting effect as well as the sound insulation effect. When the structure according to the present invention is used as such a sliding door or sliding shutter, the drawing ends of the partition members are fixed to guide members or the partition members are held as shown in FIGS. 17 to 20 and are reinforced in a direction normal to the partition faces so as to withstand the wind or like pressure in the fully drawn state.

I claim:

1. A telescopable paritition comprising:

a plurality of partition members all of substantially the same size and configuration and each in sheet form and each having a pair of spaced opposing partition faces joined together along one respective side of each and unjoined at their other sides, each said partition member having the spacing between its opposed faces increasing gradually from its joined edges toward its unconnected edges to thereby permit telescoping of one of said member into the next, guide means for supporting said partition members and permitting movement of said members between a first drawn position in which the joined sides of one said member lie adjacent to the unconnected sides of an adjoining member to a second telescoped position in which said joined sides of said one member lie adjacent to said joined sides of said adjoining member, and means for limiting the distance between said joined sides of a pair of adjoining members to a predetermined amount when said members are telescoped one into the other.

2. A structure as claimed in claim 1, wherein a lining of resilient material having a low coefficient of friction is provided at said non-connected side of each said partition member to establish intimate engagement between the inner and outer ones of said partition members at said side when drawn to provide continuous partition faces.

3. A structure as claimed in claim 1, wherein each said partition member is composed of a single sheet which is bent at its middle part to form the width of said connected side.

4. A structure as claimed in claim 3, wherein a lining of resilient material having a low coefficient of friction is provided at said non-connected side of each said partition member to close the gap between said connected side of the inner partition member and said non-connected side of the outer partition member in the fully drawn state.

5. A structure as claimed in claim 3, wherein each said partition member is provided with first interconnecting means protruding diagonally inward from said non-connected side and second interconnecting means protruding diagonally outward from said connected side, said first interconnecting means of the outer partition member engaging with said second interconnecting means of the inner partition member to draw the inner partition member therewith during drawing.

6. A structure as claimed in claim 1, wherein each said partition member is composed of a pair of partition plates disposed opposite to each other to provide said partition faces, said partition plates being bent at one of their confronting ends toward each other in a direction substantially normal to said partition faces to provide said connected side, and connecting means is provided in the bent portions to connect said partition plates together.

7. A structure as claimed in claim 6, wherein said connecting means is formed of a resilient material which resiliently biases said partition plates toward each other at their said non-connected sides.

8. A structure claimed in claim 7, wherein each said partition member comprises resilient restraining means disposed adjacent to said connected side for normally biasing said partition plates of the adjoining partition member away from each other with a force weaker then that of said connecting means, means permitting said resilient restraining means of an inner partition member to engage with a means on an adjoining outer partition member only when said members are moved relative to each other to a non-telescoped condition.

9. A structure as claimed in claim 6, wherein each said partition member is provided with first inter-connecting means protruding diagonally inward from said non-connected side and second interconnecting means protruding diagonally outward from said connected side, said first interconnecting means of the outer partition member engaging with said second interconnecting means of the inner partition member to draw the inner partition member therewith during drawing.

10. a structure as claimed in claim 1, further comprising flexible linear linking means extending between said connected side of each said partition member and that of another, said linear linking means having a sufficient length such that at least a part of said connected side of the inner partition member is situated within said non-connected side of the outer partition member in the fully drawn state.

11. A structure as claimed in claim 1, wherein each said partition member is provided with first interconnecting means protruding diagonally inwardly from said non-connected side and second interconnecting means protruding diagonally outward from said connected side, said first interconnecting means of the outer partition member engaging with said second interconnecting means of the inner partition member to draw the inner partition member therewith during drawing.

12. A structure as claimed in claim 1, wherein said partition members are supported by said guide means at an end located parallel with the moving direction thereof, and holding means comprising a pair of holding elements extending in the moving direction of said partition members for holding the other end of said partition members, said holding elements being parted by the leading partition member to hold the other end of said partition members during drawing from the telescoped state and being joined to be substantially flattened by the leading partition member during grouping into the telescoped state again.

13. A telescopable partition comprising:

a plurality of partition members all of substantially the same size and configuration and each in sheet form and each having a pair of spaced opposing partition faces, each said partition member having resilient connecting means which joins said opposed partition faces along a respective side of each face and tends to maintain said opposed faces generally parallel to each other when said partition members are in their non-telescoped state, said opposed partition faces being unjoined at their other sides, guide means for supporting said partition members and permitting movement of said members between a first drawn position in which the joined sides of one said member lie adjacent to the unconnected sides of an adjoining member and to a second telescoped position in which said joined sides of said one member lie adjacent to said joined sides of said adjoining member, and means for limiting the distance between said joined sides of a pair of adjoining members to a predetermined amount when said members are telescoped one into the other, said resilient connecting means acting when said partition members are telescoped each into the next to permit said opposed faces to diverge outwardly and thereby permit the close telescoping of all said partition members into a relatively small space.

14. The telescopable partition of claim 13 in which each said partition member further includes resilient means disposed adjacent its connected sides for exerting a force on the unconnected side of the adjoining partition member to urge the opposed faces thereof apart, which force is however less than the counterforce exerted by said resilient connecting means associated with said adjoining partition member, and aperture means at the unconnected sides of said adjoining partition member for receiving therein a part at least of said resilient means to provide interengagement between said adjoining partition members only when they have been moved to a predetermined non-telescoped position relatibe to each other.

* * * * *